United States Patent [19]

Adams et al.

[11] Patent Number: 4,855,555

[45] Date of Patent: Aug. 8, 1989

[54] MICROWAVE APPARATUS FOR THAWING FROZEN LIQUID AND A BAG HOLDER ASSEMBLY FOR USE THEREIN

[75] Inventors: Glenn N. Adams, Westcock; Gerald Beekenkamp, Paris, both of Canada

[73] Assignee: Canadian Patents and Development Limited-Societe Canadienne des Brevets et d' Exploitation Limitee, Ottawa, Canada

[21] Appl. No.: 217,766

[22] Filed: Jul. 11, 1988

[51] Int. Cl.[4] ..... H05B 6/80

[52] U.S. Cl. ..... 219/10.55 F; 219/10.55 R; 604/409; 604/114

[58] Field of Search ..... 219/10.55 F, 10.55 E, 219/10.55 A, 10.55 R, 10.55 B, 389; 604/403, 408, 409, 410, 317, 113, 114

[56] References Cited

U.S. PATENT DOCUMENTS

| | | | |
|---|---|---|---|
| 3,462,575 | 8/1969 | Holaday | 219/10.55 R |
| 4,336,435 | 6/1982 | Kashyap et al. | 219/10.55 F |
| 4,427,866 | 1/1984 | Pauly et al. | 219/10.55 B |
| 4,453,066 | 6/1984 | Mori | 219/10.55 B X |
| 4,467,163 | 8/1984 | Pauly et al. | 219/10.55 B |
| 4,520,251 | 5/1985 | Yokozeki | 219/10.55 B |
| 4,652,712 | 3/1987 | Zeipel | 219/10.55 F |
| 4,714,813 | 12/1987 | Trenchard | 219/10.55 F |

*Primary Examiner*—Philip H. Leung

[57] ABSTRACT

A holder assembly for a plastic bag of a frozen liquid, e.g. blood plasma, is designed to be manually removably mounted on an arbor that projects into a microwave oven cavity from a wall thereof. The holder is metallic and has a circular base from which a peripheral wall projects upwardly to a rim across which an apron extends. A semi-flexible bar of microwave transparent material is mounted to extend across the holder to retain the bag therein. A plurality of such arbors, e.g. four, are disposed around the oven cavity whereby a number of bags can be heated simultaneously. Each arbor is rotatable for agitating the bag holder assembly and hence the bag therein. Devices associated with each arbor detect the presence of a bag holder assembly on such arbor and also detect the temperature of thawing liquid in the bag supported in each bag holder assembly. A controller to which this information is supplied drives the oven through an appropriate program that ensures that none of the bag contents overheats.

28 Claims, 9 Drawing Sheets

MICROWAVE APPARATUS FOR THAWING FROZEN LIQUID AND A BAG HOLDER ASSEMBLY FOR USE THEREIN

FIELD OF THE INVENTION

This invention relates to the heating by microwave energy of bags of frozen blood plasma or other liquids for medical or other purposes, e.g. intravenous admixtures, that are stored in the frozen state. It is important that such liquids be thawed uniformly, with no part of the liquid being heated above a predetermined temperature.

PRIOR ART

U.S. Pat. No. 4,336,435 issued June 22, 1982 to S. Kashyap et al discloses a holder for a bag of frozen liquid for mounting in a microwave oven, including means for agitating the bag and means for monitoring the temperature of the liquid as it thaws.

SUMMARY OF THE INVENTION

The present invention provides improvements in the apparatus described in such prior patent, and, in particular, improvements in the speed and uniformity of heating of a number of such bags simultaneously in a microwave oven.

More specifically, the invention provides microwave apparatus for thawing frozen liquid in a plastic bag, comprising a microwave oven including a cavity and a source of microwave energy, a plurality (e.g. four) of separate mounting means disposed around said cavity, each for mounting a respective bag holder assembly supporting a plastic bag of frozen liquid, and means for rotating each of the mounting means to agitate a bag holder assembly mounted thereon, wherein each mounting means includes means for detecting the presence of a bag holder assembly mounted thereon, and means for sensing the temperature of thawing liquid in a bag supported in such bag holding assembly.

In the preferred embodiment, there is provided a controller for receiving signals from the temperature sensitive means of each mounting means, this controller deenergizing the source of power upon receipt of a signal indicating that thawing liquid in a bag supported in a bag holder assembly mounted on one of the mounting means has reached a predetermined temperature, e.g. 20° C.

The controller also receives signals from the presence detecting means of each mounting means to enable it to disregard signals from the temperature sensing means of any one of the mounting means that is not occupied by a bag holder assembly.

The controller also receives signals from rotation confirming means whereby to deenergize said source of power upon receipt of a signal indicating the absence of rotation of any one of the mounting means that is occupied by a bag holder assembly.

The controller is preferably programmed to operate the source of power in such a way as to take the microwave oven sequentially through an operational program involving different heat cycles.

The invention also consists of a bag holder assembly for use in the microwave apparatus described above, such assembly comprising a metallic holder having a circular base, a peripheral wall projecting upwardly from such base to a rim, and an apron extending radially inwardly from such rim at one side of the holder to form a cavity for receiving a portion of the bag that requires shielding during thawing, e.g. the portion that contains the filling and discharge ports. The bag holder assembly also includes a semi-flexible bar of microwave transparent material. The holder has means, such as slots in the base, for receiving and retaining this bar in a position in which it extends across the holder to engage the bag and retain it in the holder.

In the preferred embodiment, the holder includes a hub of plastic material adapted for removable mounting on one of the mounting means disposed around the oven cavity.

DETAILED DESCRIPTION OF THE PREFERRED EMBODIMENTS

Figure 1:
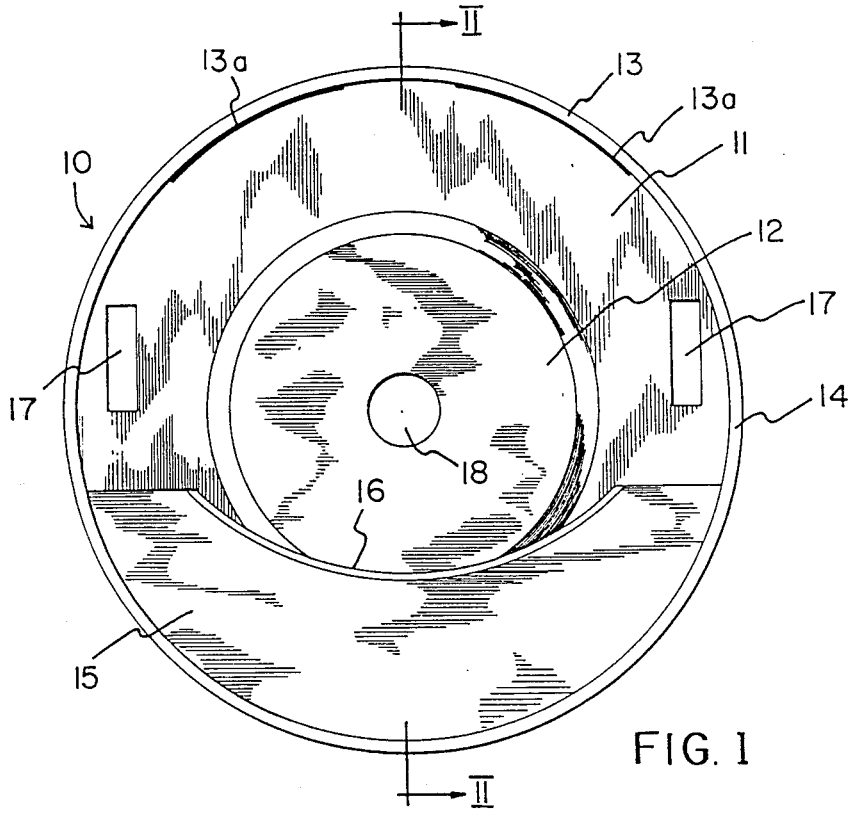
FIG. 1 is a front view or an embodiment of bag holder according to the invention.
Figure 2:
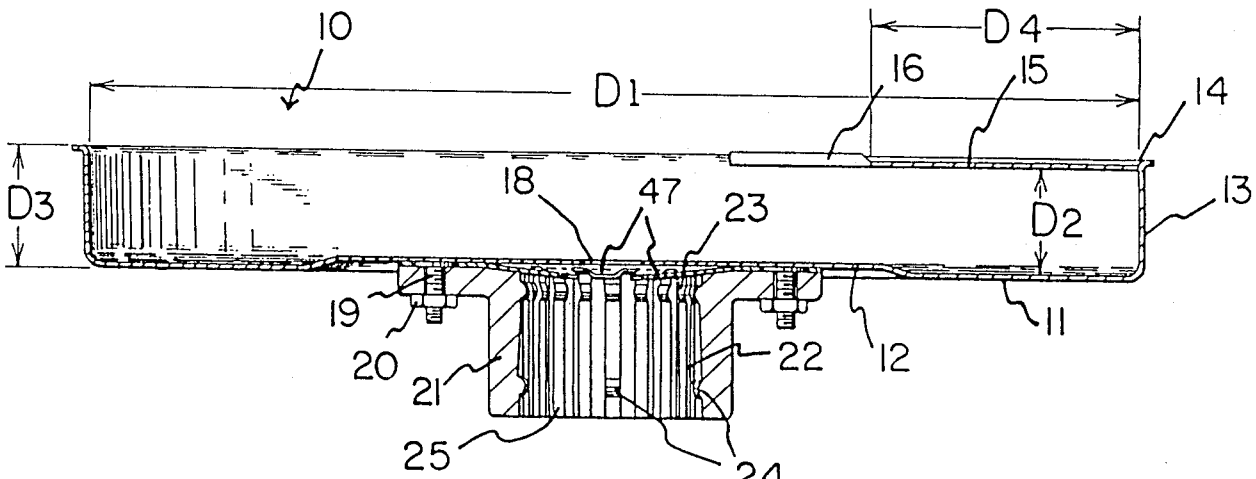
FIG. 2 is a section on II—II in FIG. 1.

FIGS. 1 and 2 show a circular, dished holder 10 that is made of metal, preferably 0.6 mm thick, non-magnetic, stainless steel. The holder has a circular base 11 with a central portion 12 that is slightly raised. A peripheral wall 13 extends up from the base 11 to a rim that has an out-turned peripheral flange 14. A generally crescentshaped, shielding apron 15 extends across one side of the top of the holder inwardly from the rim around a minor portion of the periphery, this apron 15 having an upturned lip 16. There is a pair of rectangular slots 17 in the base 11 located near the peripheral wall 13 and on approximately opposite sides of a central hole 18 in the central portion 12.

Secured to the rear of this portion 12 of the base 11 by studs 19 and nuts 20 is a hub 21 of hard plastic material. The inner periphery 22 of the hub 21 is slightly inwardly tapered and has circumferential projections 23, 24 and axial splines 25.

Figure 3:
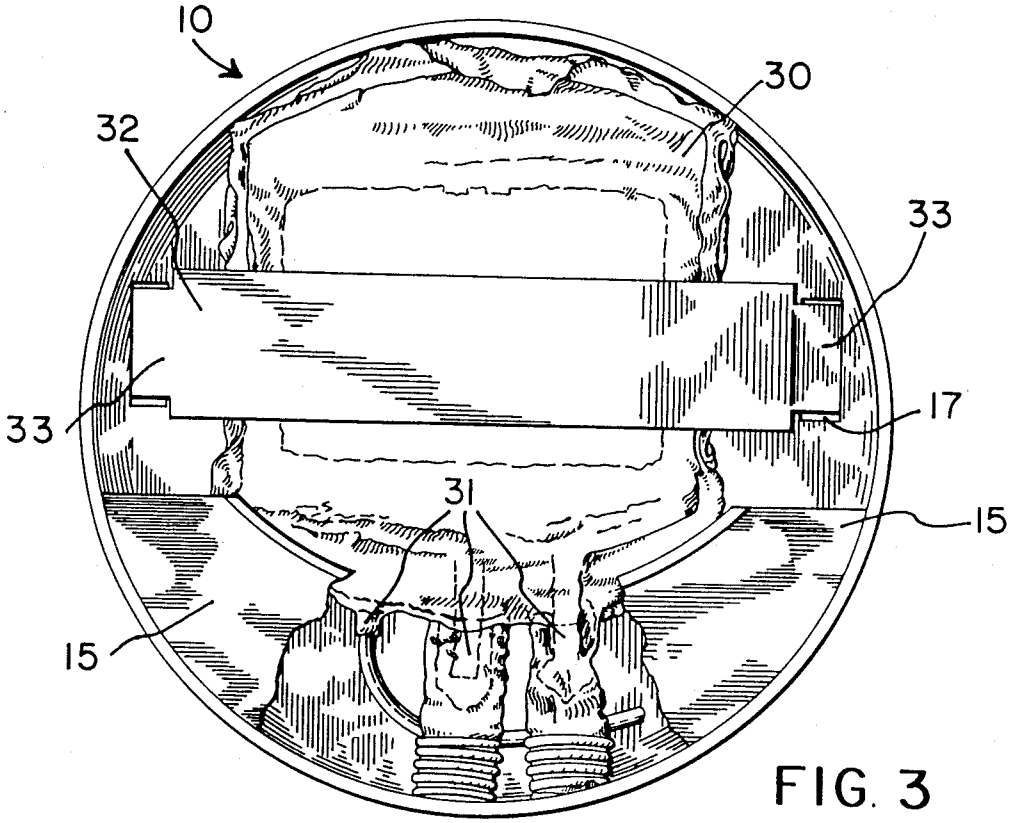
FIG. 3 is a partly cut away view, similar to FIG. 1, but showing a bag of frozen plasma secured in the holder assembly.

FIG. 3 shows the holder 10 loaded with a bag 30 of frozen blood plasma, intravenous fluid, or other liquid needed for medical or like purposes, and stored in the frozen condition. By virtue of having been completely filled with the liquid and then frozen, the bag, which when empty is flat and generally rectangular with slightly convex ends, has assumed a distorted, bulging shape. At one end the bag has three ports 31 (some bags have four ports) for filling and discharge. The bag is mounted with these ports 31 inside the cavity formed by the apron 15, in order to shield the portions of frozen liquid in these ports from the microwave energy. A bar 32 of comparatively rigid but semi-flexible plastic material is sprung into place to extend across the body of the bag 30 to secure it in the holder, the bar 32 having narrowed ends 33 that are received and retained in the slots 17.

Figure 4:
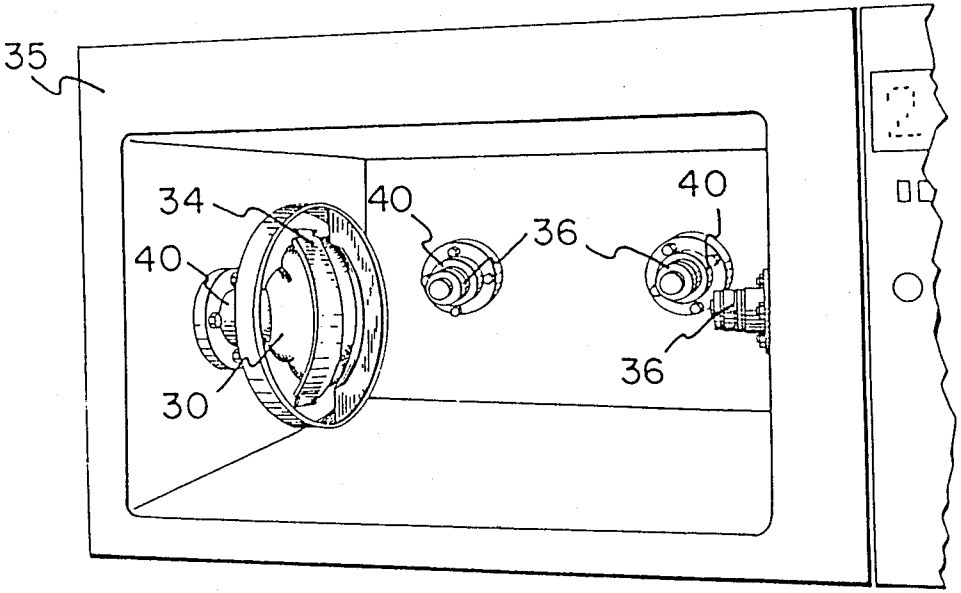
FIG. 4 is a front perspective view of a microwave oven (with the door omitted), the oven being modified for the purposes of the present invention.
Figure 5:
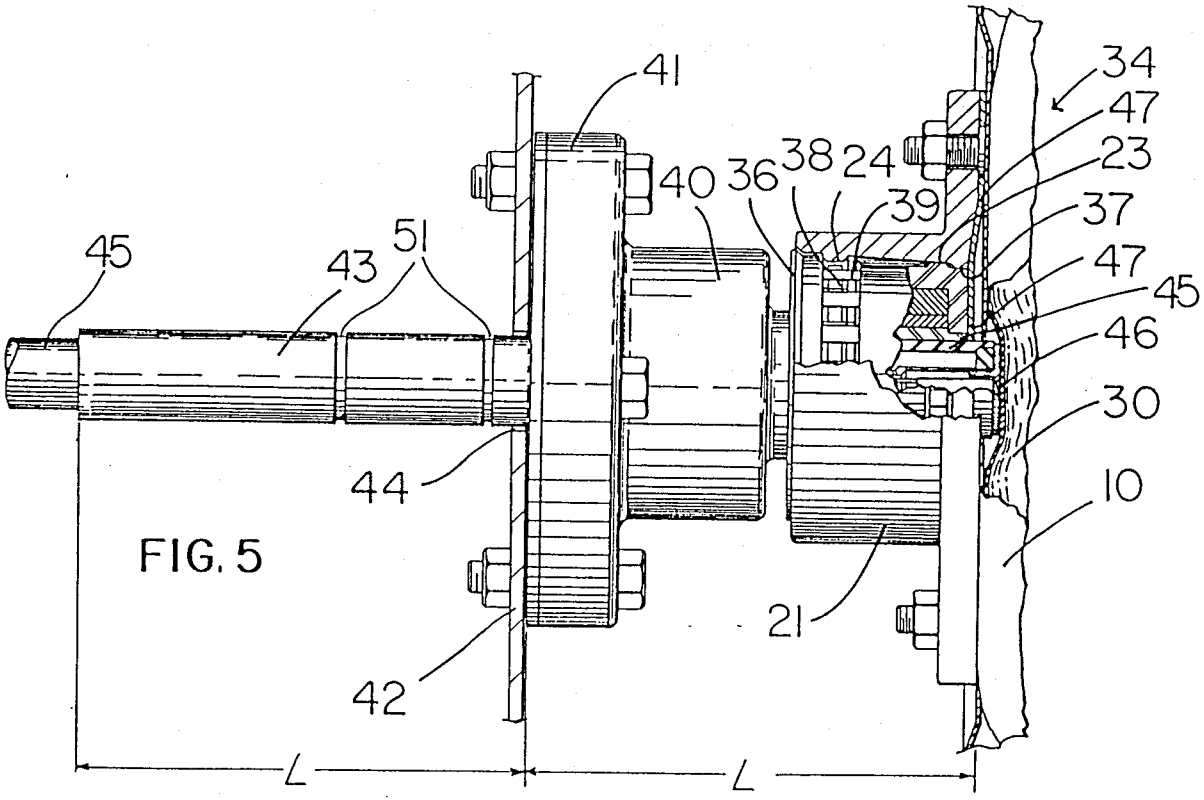
FIG. 5 is a partly sectioned and cut away, enlarged view, showing means for mounting a holder assembly on mounting means in the oven.

One such assembly 34 of holder 10 and bar 32, together with a bag 30, is shown in FIG. 4 rotatably mounted in a microwave oven 35. As seen in FIG. 5, the hub 21 of this holder can be manually pressed onto an arbor 36 where it remains firmly held in place (but nevertheless manually removable) by grooves 37, 38 that engage the projections 23, 24. Splines 39 engage the splines 25 to ensure that the holder rotates with the arbor 36. The arbor 36 is journalled in a spigot 40 having a flange portion 41 secured to a wall 42 of the oven 35. More details of this journalled mounting are shown in FIG. 7. A shaft 43 secured to the arbor 36 extends through a hole 44 in the wall 42 and is connected to a drive mechanism partially shown in FIG. 6. Electrical continuity between the bag holder 10 and the shaft 43 is ensured by a metallic spring member 47 that is welded to the holder 10 and contacts the end face of the shaft 43. This arrangement ensures grounding of the holder 10.

Axially slidably mounted inside the shaft 43 and the arbor 36, there is a probe 45 that is urged by a leaf spring 50 (FIG. 6) to press a temperature sensitive tip 46 mounted on the end of the probe 45 (and shown in detail in FIG. 8) through the hole 18 and into contact with the surface of the bag 30. This region of contact between the bag surface and the tip 46 is approximately in the middle of the bag, since this will tend to be the warmest region of the bag during the heating process. In FIG. 5 the probe is shown slightly distorting the bag inwardly, assuming that some thawing of the frozen product will have already taken place. The close contact between the probe 46 and the bag is ensured by the spring 50 and the firm retention of the bag in the holder 10 by the bar 32.

The design is such as to prevent the escape of microwave energy. To avoid leakage of microwave energy, the length 2L of the shaft 43 should be made approximately equal to one wavelength λ of the microwave energy, i.e. approximately 12.18 cm in air, the oven wall 42 being equally spaced by the distance L between the two ends of the shaft 43, as shown in FIG. 5.

Figure 6:
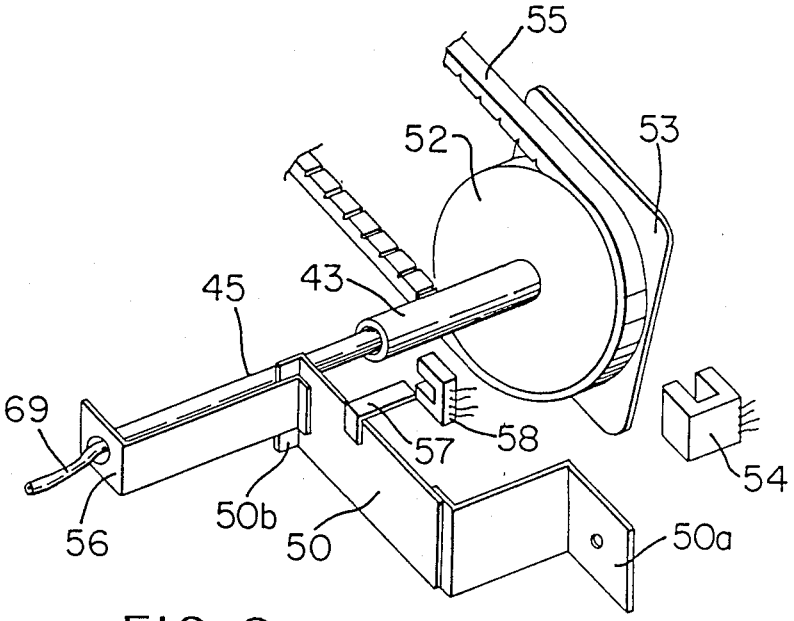
FIG. 6 is a perspective, partial view of a drive mechanism for use with the parts shown in FIG. 5.
Figure 7:
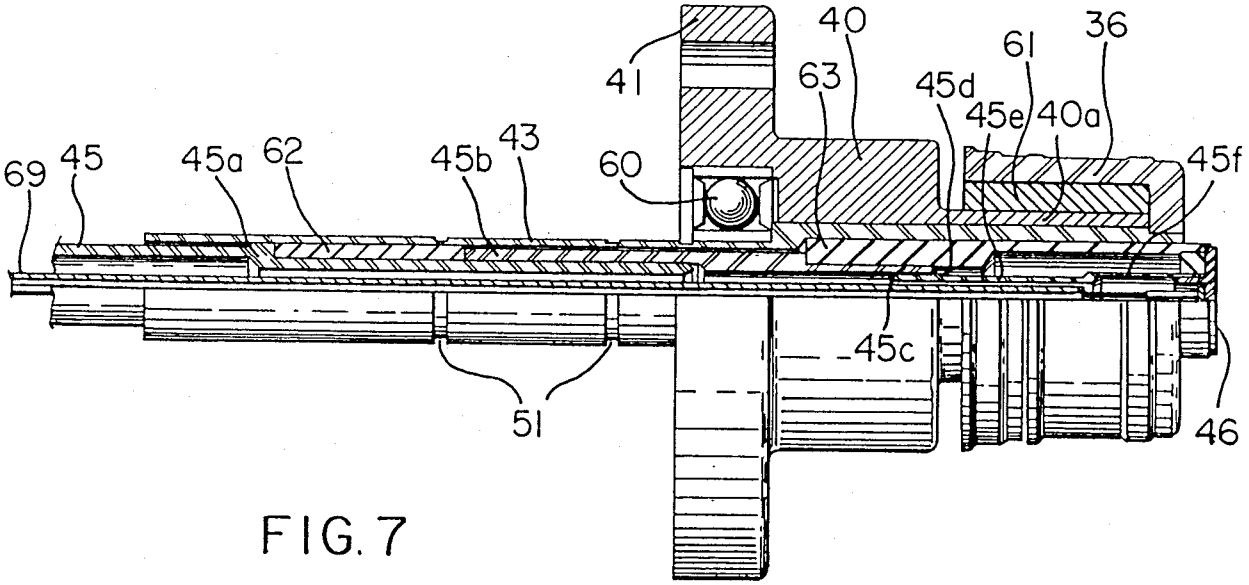
FIG. 7 is a partly sectioned view showing the internal structure of the holder mounting means.

Referring to FIG. 6, a pulley 52 and a so-called flag 53 for cooperation with an optical interrupter 54 for sensing passage of the flag 53 are mounted on the grooves 51 (FIG. 5) of the shaft 43. The pulley 52 is connected by a belt 55 to a driving mechanism (not shown) including a motor. The spring 50 is secured at one end 50*a* to the wall 42, and, at its other end 50*b*, carries a bracket 56 that is detachably secured to the end of the probe 45 and serves for electrical grounding of the probe 45. A flag 57 is arranged to cooperate with an optical interrupter 58 for sensing the axial position of the probe 45 in the shaft 43. FIG. 6 shows the probe 45 in a position in which it is forced outwardly by an unthawed bag 30 against the urging of the spring 50.

FIG. 7 is similar to FIG. 5, except that the arbor 36 is shown without a hub 21 thereon, and the internal structure of the assembly is illustrated. Also, in Figure 7, the probe 45 is shown full compressed as if in contact with a bag of frozen liquid.

The spigot 40 is fixed, while the arbor 36 is mounted to rotate with the shaft 43. A ball-bearing 60 journals the shaft 43 in the flange portion 41 of the spigot 40 and a Graphalloy bushing 61 journals the arbor 36 on an axial projection 40*a* from the spigot 40. The bushing 61 also grounds the arbor to the spigot and hence to the cavity walls. The probe 45 inside the shaft 43 does not rotate, being fixed in this respect by its connection to the bracket 56. The probe 45 consists of a first section 45*a* which engages with a second section 45*b*, these sections together defining a cavity housing a Teflon bearing 62. The probe section 45*b* has an extension 45*c* that abuts against a projection 45*d* of a further probe section 45*e*. A Teflon bearing 63 is located between the probe extension 45*c* and the shaft 43. Teflon bearings 62 and 63 allow the probe to move axially as well as allowing it to be rotationally fixed while the shaft 43 rotates.

Figure 8:
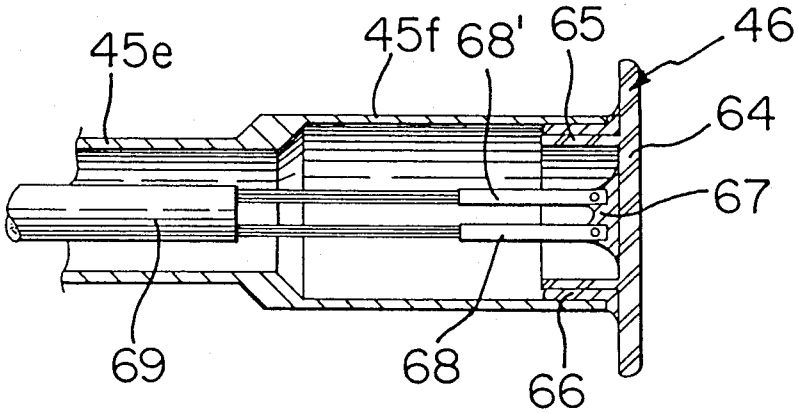
FIG. 8 is a further enlarged, sectioned view of the tip of a probe in such means.

As best seen in FIG. 8, the probe section 45*e* has an end portion 45*f* that supports the probe tip 46. Because of the fact that the probe does not rotate, this probe tip rubs on the bag 30 as it rotates with the arbor 36. The tip 46 consists of a copper cap 64 that has an inwardly extending skirt portion 65 that is joined to the end of the probe end portion 45*f* by electrically conductive cement 66. Secured to the inner surface of the cap 64 by heat conductive cement 67, there are primary and back-up thermistors 68 and 68′ with lead wires 69. The lead wires 69 are shielded by the continuous metal structure of the probe. They are further shielded (against fields induced by currents circulating in the probe structure) by a braid shield (not shown) in the cable. This braid shield is grounded to the probe structure only at one point, near the active end of the probe (actually at 45*c*), to avoid ground loops.

To provide a microwave choke and hence minimise leakage of microwave energy along the probe assembly, the length of the air gap between the probe section 45*b* and the shaft 43, i.e. extending between the ends of the bearings 62 and 63, should be equal to $\frac{1}{4}$ λ (in air), and the length of the bearing 62 itself should be equal to $\frac{1}{4}$ λ (in Teflon).

FIG. 4 illustrates four such mounting assemblies in the oven 35, one on each end wall and two on the rear wall of a rectangular oven. Other arrangements for mounting a plurality of bag and holder assemblies 34 for simultaneous heating in a microwave oven can be employed and may vary with the shape of the oven cavity.

The drive mechanism will be arranged to simultaneously oscillate and advance the rotation of each holder assembly, for example, turning it in one direction about 270°, then reversing the direction of rotation for about 180°, then turning it forward again about 270°, and so on. In this way, the holder assembly is rocked to ensure mixing of the liquid with the still frozen portions in the bag during the thawing process, while also ensuring a constantly varying orientation of the assembly relative to the microwave energy field by the progressive advancement of the average rotational position of the holder assembly in the field.

It has been found that operating with the standard microwave frequency of 2450 MHz and using a standard 300 ml thin plastic plasma bag, the major dimensions of the holder 10 should preferably be held within relatively close limits, i.e. within a few percent of the following:

(a) The diameter D1 of the holder 10 without the flange 14, i.e. the diameter of the base 11, = 17.5 cm.

(b) The depth D2 of the cavity formed by the apron 15, i.e. the distance from the base 11 to the apron 15, = 1.8 cm, while the full depth D3 of the external dimensions = 2 cm.

(c) The width D4 of the apron at its center=4.5 cm.

Other dimensions that are less critical but nevertheless should preferably be adopted are:

(d) The width of the flange 14=0.3 cm.

(e) The width of the lip 16=0.3 cm, turned up at an angle of 30° to provide a flat contact with the bag to prevent damaging it.

(f) The elevation of the central portion 12 above the base 11=0.15 cm.

(g) The diameter of the hole 18=2 cm.

(h) The lower ends of the slots 17 aligned with a diameter of the holder, such slots having a height of 2.8 cm and a width of 0.8 cm.

(i) The length of the bar 32=19.5 cm, with a width=4 cm, the reduced ends 33 having a length=2.5 cm and a width=2.5 cm.

The reason why the central portion 12 is raised is to ensure firm contact between the holder 10 and the bag in this area.

A coating 13*a* of dielectric material (high temperature epoxy) is applied to two areas of the peripheral wall 13 to prevent excessive current flow between the plasma and the wall via the corner of the bag, which could cause overheating.

Comparing the holder disclosed herein with that illustrated in the prior patent referred to above, the circular shape of the holder reduces tooling costs compared with a square or rectangular holder. It has also been found that the absence of complete shielding at the sides of the bag has not resulted in excessive heating of these areas. The circular shape provides the best accommodation for the bag within the space restrictions in the oven, and the least requirement for bending the bag tubes when the bag is installed in the holder.

When two, three or preferably four of the mounting stations are occupied so that a plurality of loaded bag holders are subjected to the microwave energy in the oven simultaneously, it is necessary to monitor the temperature of each bag separately, and to terminate heating when the liquid in any one of them reaches the maximum acceptable temperature, e.g. 20° C. Because an unoccupied probe will often be warmer than this temperature, it is necessary to identify which of the four stations is or are occupied. With four thawing stations, it is desirable to have a display (not shown) to indicate the temperature status of each station. The importance of avoiding excessive plasma temperatures is the reason why the second, back-up thermistor 68' is incorporated in each temperature probe, the handling of the information from the second thermistor being kept independent of that from the primary thermistor 68 as far as practicable.

Experience has shown that an optimum thawing time is attained if the level of microwave heating is varied (programmed) during the thawing cycle.

A typical operational program will involve a series of different heat cycles: a first, 50% power, fixed time cycle; an intermediate, 50% power, cycle; an intermediate, 75% power, cycle; and an intermediate, 100% power, cycle. The microwave power output will be controlled by duty cycling the magnetron voltage over a 10 second period. Except for the first cycle, which is for 30 seconds, the cycles will be of variable duration, the microwave power output being controlled by the maximum temperature T detected by the probes of all the occupied stations. After the first fixed cycle has been completed, the relationships will be

| Temperature, °C. | Power Level |
|---|---|
| $T < 15$ | 50%, 75% or 100% depending on the elapsed thawing time (so-called intermediate cycles) |
| $15 < T < 20$ | 50% (so-called final cycle) |
| $T > 20$ | OFF |

Figure 9:
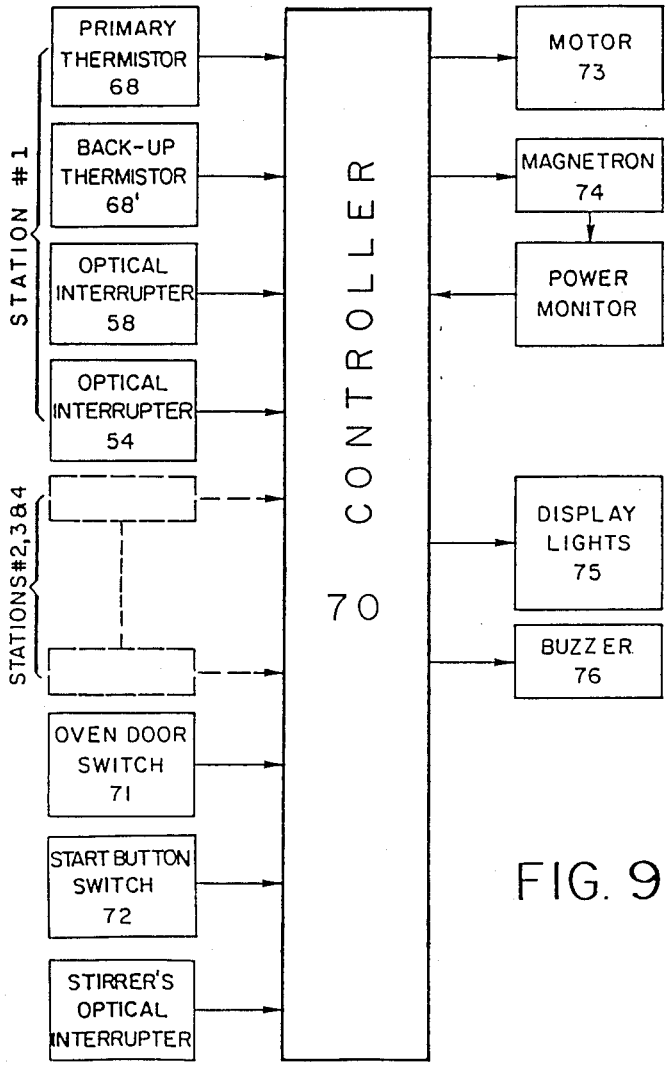
FIG. 9 is a block diagram illustrating the performance of the apparatus.

Such a result can be obtained by means of a suitably programmed controller 70 (FIG. 9) that receives inputs from each of the four stations 1 to 4, such inputs coming respectively from the primary and back-up thermistors 68, 68', the optical interrupter 58 which senses the presence or absence of a loaded bag holder at the station concerned, and the optical interrupter 54 which senses that the rotation (mechanical agitation) of the bag holder is taking place. Other inputs to the controller 70 are from switches 71 and 72 that respectively indicate that the oven door is closed and that the start button has been activated, and from an optical interrupter (not shown) to monitor rotation of the stirrer, if the oven is fitted with a stirrer.

Outputs from the controller 70 control a motor 73 for driving each of the belts 55, a magnetron 74, LED display lights 75 on a control panel and a buzzer 76. A power monitor 77 keeps the controller advised that the magnetron is operating correctly.

The following steps are taken when thawing plasma. First, one to four bags of plasma are installed in bag holders and attached at the mounting stations. Next, with the door closed, the start button is pressed. A heat light will turn on and remain lit for the duration of the thawing process. A yellow station light corresponding to each occupied station will also be lit for the first 35 seconds of thawing.

The controller begins monitoring the plasma temperature after this 35 second interval. When any one of the bags reaches approximately 15° C. (a so-called second temperature, a few degrees below the "predetermined temperature" of 20° C.), a yellow station light corresponding to that station will again be lit. As the bag continues to warm to 18° C., the yellow station light is shut off and a respective green station light is turned on. At 20° C. the buzzer will sound and the apparatus enters its halt state. In this state the controller will still monitor the plasma temperatures and update the front panel station lights, but the microwave energy and agitation system are shut off.

Plasma at those stations indicated by green station lights may now be removed. The apparatus can be restarted containing only the remaining plasma (plasma whose station lights have not yet turned green).

Opening and closing the oven door readies it for another thawing cycle. If thawing is attempted with the door open, the buzzer will sound but no other actions will occur.

The apparatus has a built-in test procedure that allows the operator to reset the control system. This reset procedure can be performed by pressing the start button when the door is unlatched and no stations are occupied.

Red station lights on the front panel turn on when certain error conditions have occurred.

Situations that can cause the controller to enter the halt state are an open door; failure of mechanical agitation; a thermistor error as demonstrated by a comparison of the readings received from the primary and back-up thermistors with a normal range of readings; a reading from a thermistor in excess of 20° C. from an occupied station. It should be noted that the controller ignores readings received from unoccupied stations, except for the check (mentioned below) at the end of the fixed time cycle. From the viewpoint of the controller, the first step in the 50% fixed time cycle is to identify the occupied stations. The display informs the operator as to which stations are occupied by turning on yellow lights for those stations containing plasma. These remain on for the duration of this cycle. The next step is to turn on the agitation system and wait for it to attain proper speed. The mechanical system error checking is then enabled. Following this, the magnetron is turned on at 50% of full power, for 30 seconds. The control unit then enters the 50% intermediate cycle, i.e. the first intermediate cycle, as explained above.

At the end of the fixed time cycle, a check is done on all unoccupied stations to ensure that none of the temperatures has dropped below approximately 10° C. If any has, then the controller has failed to identify an occupied station due to a hardware error. This initiates the halt state and the thawing process is stopped.

The intermediate cycles are all very similar. In the 50% intermediate cycle, which runs for a maximum of 90 seconds, subject to the temperature T, the maximum allowable power level is 50% of full power. In the 75% intermediate cycle, which runs for a maximum of 60 seconds subject to the temperature T, the maximum allowable power level is 75% of full power. The 100% intermediate cycle, which has no time limit, runs at full power. The intermediate cycles are terminated when T rises to 15° C. and the final cycle is terminated when T rises to 20° C. Any cycle is terminated when an error is detected.

We claim:

1. Microwave apparatus for thawing frozen liquid in a plastic bag, comprising (a) a microwave oven including a cavity and a source of microwave energy, (b) a plurality of separate mounting means each projecting from a wall of said cavity at a different location around said cavity, each said mounting means being adapted for mounting a respective bag holder assembly supporting a plastic bag of frozen liquid, (c) means for rotating each of said mounting means whereby, when a said bag holder assembly is mounted thereon, to agitate the bag holder assembly in a substantially vertical plane about a substantially horizontal axis, (d) each said mounting means including means for sensing the temperature of thawing liquid in a bag supported in such a bag holding assembly when mounted in said mounting means, and (e) means for controlling the energy source as a function of said sensed temperature in each mounting means.

2. Microwave apparatus according to claim 1, wherein each mounting means includes means for detecting the presence of a bag holder assembly mounted thereon.

3. Microwave apparatus according to claim 2, including a controller for receiving signals from the temperature sensing means of each said mounting means and for deenergizing said source of power upon receipt of a signal indicating that thawing liquid in a bag supported in a bag holder assembly mounted on at least one of said mounting means has reached a predetermined temperature, wherein said controller is connected to receive signals from said presence detecting means of each said mounting means to inform said controller of any said mounting means unoccupied by a bag holder assembly whereby to enable said controller to disregard signals from the temperature sensing means of any such unoccupied mounting means.

4. Microwave apparatus according to claim 3 including means for confirming rotation of each said mounting means, said controller being connected to receive signals from said rotation confirming means whereby to enable said controller to deenergize said source of power upon receipt of a signal indicating the absence of rotation of a mounting means occupied by a bag holder assembly.

5. Microwave apparatus according to claim 2, wherein said means for rotating each mounting means comprises a hollow shaft terminating in an arbor, and said presence detecting means comprises a probe axially slidable in said shaft and spring urged to pass through a hole in a said bag holder assembly to bear against and hence sense the presence of a bag therein, said probe terminating in a tip containing said temperature sensing means.

6. Microwave apparatus according to claim 1, including a controller for receiving signals from the temperature sensing means of each said mounting means and for deenergizing said source of power upon receipt of a signal indicating that thawing liquid in a bag supported in a bag holder assembly mounted on at least one of said mounting means has reached a predetermined temperature.

7. Microwave apparatus according to claim 6, wherein said predetermined temperature is approximately 20° C.

8. Microwave apparatus according to claim 6, wherein said controller is programmed to operate said source of power to take said microwave oven sequentially through an operational program involving different heat cycles.

9. Microwave apparatus according to claim 8, wherein said heat cycles comprise a first cycle of fixed time duration at a relatively low power, at least one intermediate cycle of increased power terminated when the temperature of the liquid in a said bag has reached a second temperature a few degrees below said predetermined temperature, and a final cycle at relatively low power terminating when the liquid in a said bag has reached said predetermined temperature.

10. Microwave apparatus according to claim 1, wherein each said mounting means includes means for electrically grounding a bag holder assembly mounted thereon to said oven cavity.

11. Microwave apparatus according to claim 1, wherein each mounting means comprises a microwave choke for minimising leakage of microwave energy from said oven cavity.

12. Microwave apparatus according to claim 1 in combination with a bag holder assembly, wherein said bag holder assembly comprises (e) a metallic holder having a circular base, a peripheral wall projecting upwardly from said base to a rim, and an apron extending radially inwardly from said rim at one side of the holder to form a cavity for receiving a portion of the bag requiring shielding during thawing, and (f) a semi-flexible bar of microwave transparent material, (g) the holder including means for receiving and retaining said bar to extend across the holder to engage the bag and retain the bag in the holder.

13. Microwave apparatus according to claim 12, wherein said means for receiving and retaining the bar in the holder comprise a pair of slots located in said base on opposite sides of the holder adjacent the peripheral wall.

14. Microwave apparatus according to claim 12, wherein said apron is substantially crescent-shaped.

15. Microwave apparatus according to claim 12, including a hub of plastic material secured to the holder and adapted for removable mounting on a rotatable arbor.

16. Microwave apparatus according to claim 15, wherein said hub includes a metallic spring member for providing electrical continuity between the holder and a portion of said mounting means electrically grounded to the oven cavity.

17. Microwave apparatus according to claim 12, wherein the base has a central, raised portion for engagement with the bag, said raised portion having a central hole therein.

18. Microwave apparatus according to claim 12, wherein the over operates at a frequency of 2450 MHz and wherein the diameter of the base of the holder is approximately 17.5 cm, and the depth of the cavity formed between the apron and the base is approximately 1.8 cm.

19. Microwave apparatus according to claim 18, wherein the width of the apron at its center is approximately 4.5 cm.

20. Microwave apparatus according to claim 19, wherein the base has a central portion raised by approximately 0.15 cm from the remainder of the base.

21. Microwave apparatus according to claim 1, wherein said bag holder assembly generally defines a plane and said axis of rotation extends substantially centrally through each bag holder assembly perpendicular to said plane, when said bag holder assembly is mounted in a said mounting means.

22. A bag holder assembly for mounting a plastic bag of a frozen liquid in a microwave oven for thawing; said assembly comprising (a) a metallic holder having a circular base, a peripheral wall projecting upwardly from said base to a rim, and an apron extending radially inwardly from said rim at one side of the holder to form a cavity for receiving a portion of the bag requiring shielding during thawing, and (b) a semi-flexible bar of microwave transparent material, (c) the holder including means for receiving and retaining said bar to extend across the holder to engage the bag and retain the bag in the holder, (d) wherein said means for receiving and retaining the bar in the holder comprise a pair of slots located in said base on opposite sides of the holder adjacent the peripheral wall.

23. A bag holder assembly according to claim 22, wherein said apron is substantially crescent-shaped.

24. A bag holder assembly for mounting a plastic bag of a frozen liquid in a microwave over for thawing; said assembly comprising (a) a metallic holder having a circular base, a peripheral wall projecting upwardly from said base to a rim, and an apron extending radially inwardly from said rim at one side of the holder to form a cavity for receiving a portion of the bag requiring shielding during thawing, and (b) a semi-flexible bar of microwave transparent material, (c) the holder including means for receiving and retaining said bar to extend across the holder to engage the bag and retain the bag in the holder, and (d) including a hub of plastic material secured to the holder and adapted for removable mounting on a rotatable arbor, wherein said hub includes a metallic spring member for providing electrical continuity between the holder and a probe in said arbor.

25. A bag holder assembly for mounting a plastic bag of a frozen liquid in a microwave oven for thawing; said assembly comprising (a) a metallic holder having a circular base, a peripheral wall projecting upwardly from said base to a rim, and an apron extending radially inwardly from said rim at one side of the holder to form a cavity for receiving a portion of the bag requiring shielding during thawing, and (b) a semi-flexible bar of microwave transparent material, (c) the holder including means for receiving and retaining said bar to extend across the holder to engage the bag and retain the bag in the holder, (d) wherein the base has a central, raised portion for engagement with the bag, said raised portion having a central hold therein.

26. A bag holder assembly for mounting a plastic bag of a frozen liquid in a microwave oven operating at a frequency of 2450 MHz for thawing; said assembly comprising (a) a metallic holder having a circular base, a peripheral wall projecting upwardly from said base to a rim, and an apron extending radially inwardly from said rim at one side of the holder to form a cavity for receiving a portion of the bag requiring shielding during thawing, and (b) a semi-flexible bar of microwave transparent material, (c) the holder including means for receiving and retaining said bar to extend across the holder to engage the bag and retain the bag in the holder, (d) wherein the diameter of the base of the holder is approximately 17.5 cm, and the depth of the cavity formed between the apron and the base is approximately 1.8 cm.

27. A bag holder assembly according to claim 26, wherein the width of the apron at its center is approximately 4.5 cm.

28. A bag holder assembly according to claim 27, wherein the base has a central portion raised by approximately 0.15 cm from the remainder of the base.

* * * * *